US006006830A

United States Patent [19]

Barron et al.

[11] Patent Number: 6,006,830

[45] Date of Patent: Dec. 28, 1999

[54] CASING CENTRALISER

[75] Inventors: William Barron, Aberdeen; Ian Alistair Kirk, Peterculter; Alistair Bertram Clark, Westhill, all of United Kingdom

[73] Assignee: Downhole Products (UK) Limited, Aberdeen, United Kingdom

[21] Appl. No.: 09/090,722

[22] Filed: Jun. 4, 1998

Related U.S. Application Data

[62] Division of application No. 08/850,655, May 2, 1997, Pat. No. 5,797,455, which is a continuation of application No. 08/401,860, Mar. 10, 1995, abandoned.

[30] Foreign Application Priority Data

Mar. 12, 1994 [GB] United Kingdom ..... 9404857

[51] Int. Cl.[6] ..... E21B 17/10

[52] U.S. Cl. ..... 166/241.6; 175/325.1

[58] Field of Search ..... 166/241.1, 241.6, 166/241.3, 173, 208, 382; 175/325.1, 325.2, 325.3, 325.5

[56] References Cited

U.S. PATENT DOCUMENTS

| | | |
|---|---|---|
| 2,388,416 | 11/1945 | Johnson . |
| 4,436,158 | 3/1984 | Carstensen . |
| 4,984,633 | 1/1991 | Langer et al. . |

FOREIGN PATENT DOCUMENTS

| | | |
|---|---|---|
| 1154380 | 9/1983 | Canada . |
| 2935401 | 1/1979 | Germany . |
| 682362 | 5/1952 | United Kingdom . |
| 2171436 | 8/1986 | United Kingdom . |
| 2197008 | 11/1988 | United Kingdom . |
| 2249333 | 6/1992 | United Kingdom . |
| 2282615 | 12/1995 | United Kingdom . |
| 91/05936 | 2/1991 | WIPO . |
| 95/10685 | 4/1995 | WIPO . |

OTHER PUBLICATIONS

Correspondence from Fitzpatrick to the U.K. Patent Office with attachments: U.K. Patent No. GB–2171436; and price quotation from Perth Foundry Ltd. to Frank's Casing Crews (U.K.) Ltd. dated Jul. 26, 1988 (Total pages=11).

Price quotation from Perth Foundry Ltd. to Frank's Casing Crews (U.K.) Ltd. dated Jul. 26, 1988 (Total pages=1).

Statutory Declaration of Alan Male of Ray Oil Tool Co. Ltd. with attachments: Exhibits AM1, AM2, AM3, and AM4 (Total pages=38).

Metals Handbook Ninth Edition vol. 2 Properties and selection: Nonferrous Alloys and Pure Metals p. 640 (Total pages=1).

Marquesa Trademark Search System for U.K. Trademark Registration No. 1001644 for Cominco Ltd. dated Apr. 5, 1996 (Total pages=1).

Correspondence from Cominco to Mr. Alan Male, dated Apr. 9, 1996 with 13–page brochure and 4–page brochure (Total Pages=18).

Affidavit of Mike Weeren, State of Texas, County of Jefferson, dated Feb. 8, 1996 (Total Pages=1).

(List continued on next page.)

*Primary Examiner*—Frank Tsay
*Attorney, Agent, or Firm*—Ratner & Prestia

[57] ABSTRACT

A casing centraliser (10) includes an annular body (12) and a substantially cylindrical bore (16) extending longitudinally through the body (12). A number of blades (14) extend longitudinally along the body (12) and are circumferentially distributed around the body (12) to define a flow path between each adjacent pair of blades (14). Each flow path provides a fluid flow path between longitudinally opposite ends of the centraliser (10) and each blade (14) has a radially outer edge providing a well bore contacting surface. The cylindrical bore (16) through the body (12) is a clearance fit around casing intended to be centralised by the centraliser (10). The centraliser (10) is typically manufactured from a material which includes zinc and is preferably a zinc alloy.

9 Claims, 5 Drawing Sheets

OTHER PUBLICATIONS

Affidavit of George D. Robbins, III, State of Louisiana, Parish of Lafayette, dated Feb. 8, 1996, with Exhibits A, B, and C (Total Pages=5).

Correspondence from Fitzpatricks to British Patent Office with attachments: Purchase Order from Ray Oil Tool Co., Inc. to Weeren P.O. No. 0746 dated Jun. 15, 1989; Invoice form Weeren Enterprises to Ray Oil Tool Co., Inc. Invoice No. 4420 dated Jul. 1, 1989; and Letter from Mike Weeren to Robby Robins at Ray Oil Tool Co., Inc. dated. Oct. 5, 1995 (Total Pages=4).

Statement of Grounds Under Rule 75(1) in the matters of British Patent NO. 2285649B Downhole Products (UK) Ltd. and of Application Under Section 72(1) by Ray Oil Tool Co., Ltd. (Total Pages=4).

"Intrastat Classification Nomenclature 1995, from Customs and Excise" Chapter, 79, "Zinc and Articles Thereof" (Total Pages=1).

Purchase Order of Ray Oil Tool Co., Inc. from Robby Robbins to Weeren, Purchase Order No. 0746, dated Jun. 15, 1989 (Total Pates=1).

Counter–Statement Under Rule 75(3) in the matter of U.K. Patent No. 2285649B in the name Downhole Products (UK) Limited ("the Proprietor") and an application under s.72(1) of the Patents Act 1977 by Ray Oil Tool Co., Ltd.("the Applicant") (Total Pages=2).

Compressoin Test from Ray Oil Tool Co., Inc., 2 pages.

Korly Alloys, Metals Cominco, 10 pages.

"Critical Technologies for Success in Extended Reach Drilling", SPE International, SPE 28293, pp. 23–37, (1994).

Correspondence from J.B. Hall to P.J. Hurley dated Aug. 13, 1979, 1 page.

M.J. Barber and P.E. Jones, "A New Family of Foundry Alloys", 9 pages, Jan. 17, 1980.

"Typical Properties Profile of Zinc Casting Material", A Systems Approach To Zinc Casting Alloys, Cominco Catalogue, Nov. 1992, p. 16.

CASING CENTRALISER

This application is a divisional of Ser. No. 08/850,655 filed May 2, 1997, now U.S. Pat. No. 5,797,455 which is a continuation of Ser. No. 08/401,860 filed Mar. 10, 1995, now abandoned.

This invention relates to a casing centralizer and relates more particularly but not exclusively to a casing centraliser for facilitating the cementing of casing in a well.

When a well has been drilled for the eventual production of hydrocarbons, one of the procedures commonly employed in readying the well for production comprises emplacing a hollow tubular casing in the well, and filling the space between the exterior of the casing and the well bore with cement, principally as a sealant and also as a mechanical support for the casing. Since it is desirable that the casing be centralized in the well bore when cemented, proposals have been made for providing the casing (prior to cementing) with externally mounted centralisers to hold the casing away from the well bore and towards the centre of the bore.

According to a first aspect of the present invention there is provided a casing centralizer comprising an annular body, a substantially cylindrical bore extending longitudinally through said body, and a peripheral array of a plurality of longitudinally extending blades circumferentially distributed around said body to define a flow path between each circumferentially adjacent pair of said blades, each said flow path providing a fluid flow path between longitudinally opposite ends of said centraliser, each said blade having a radially outer edge providing a well bore-contacting surface, and said cylindrical bore through said body being a clearance fit around tubular casing intended to be centralised by said casing centralizer.

Said centraliser is preferably free of any means tightly gripping a casing when said centraliser is installed thereon whereby said centraliser and said casing are mutually rotatable.

Said centraliser may be formed of a zinc alloy, which alloy is preferably one of the "ZA" range of zinc alloys supplied by Brock Alloys (GB).

Said blades are preferably mutually substantially equidistantly distributed around said body. Said blades preferably each extend circumferentially at least part-way around said body between longitudinally opposite ends thereof to provide a circumferential distribution of each said well bore-contacting surface. Each said blade preferably has a radially inner root integral with said body, each said radially inner root preferably being circumferentially wider than the respective radially outer edge. Said blades are preferably circumferentially wider at one end of the centraliser than at the other end, said one end preferably the lower end of the centraliser in use thereof. Said centraliser preferably has five of said blades.

Longitudinally opposite ends of said blades and/or of said body may be chamfered or tapered whereby to facilitate passage of said centraliser down a well bore.

According to a second asgpect of the present invention there is provided a centraliser stop collar for longitudinally restraining a casing centraliser according to the first aspect of the present invention when installed upon casing, said stop collar comprising a ring having a substantially cylindrical bore extending longitudinally therethrough, said bore being dimensioned to fit around said casingg, said ring having longitudinal lock means for longitudinally locking said collar to said casing.

Said lock means preferably comprises one or more internally threaded bores extending radially through said ring, and a screw-threaded fastener in each said internally threaded bore, each said fastener being screwable into collar-locking contact with said casing.

Said ring may be formed of a zinc alloy which is preferably the same alloy as that of which the contraliser is formed. Each said internally threaded bore may be defined by an initially separate thread insert forming an integral part of said collar when fabricated, for example by being cast into the ring, and said thread inserts may be formed of materials which are substantially different from that of the ring, eg of brass or steel as compared to a zinc alloy.

According to a third aspect of the present invention there is provided a combination of hollow tubular well casing and at least one casing centraliser according to the first aspect of the present invention fitted on said casing, preferably to be rotatable thereon.

The or each said centraliser may be longitudinally restrained by a respective stop collar according to the second aspect of the present invention and installed upon said casing at or adjacent one end of the respective centraliser. One or more of said centralisers may be longitudinally restrained by a respective pair of stop collars according to the second aspect of the present invention, one of said pair of stop collars being installed upon said casing at or adjacent each longitudinally opposite end of the respective centraliser.

According to a fourth aspect of the present invention there is provided a method of cementing a hollow tubular well casing into a well bore, said method comprising the step of fitting said casing with at least one centraliser according to the first aspect of the present invention to form a combination in accordance with the third aspect of the present invention, together with a necessary or desirable number of stop collars in accordance with the second aspect of the present invention, locating said combination in said well bore much that the or each said centraliser provides at least a casing-centralising function for said casing within said well bore and pumping cement into voids between the exterior of said casing and the bore of the said well.

Embodiments of the invention will now be described by way of example, with reference to the accompanying drawings wherein.

Figure 1:
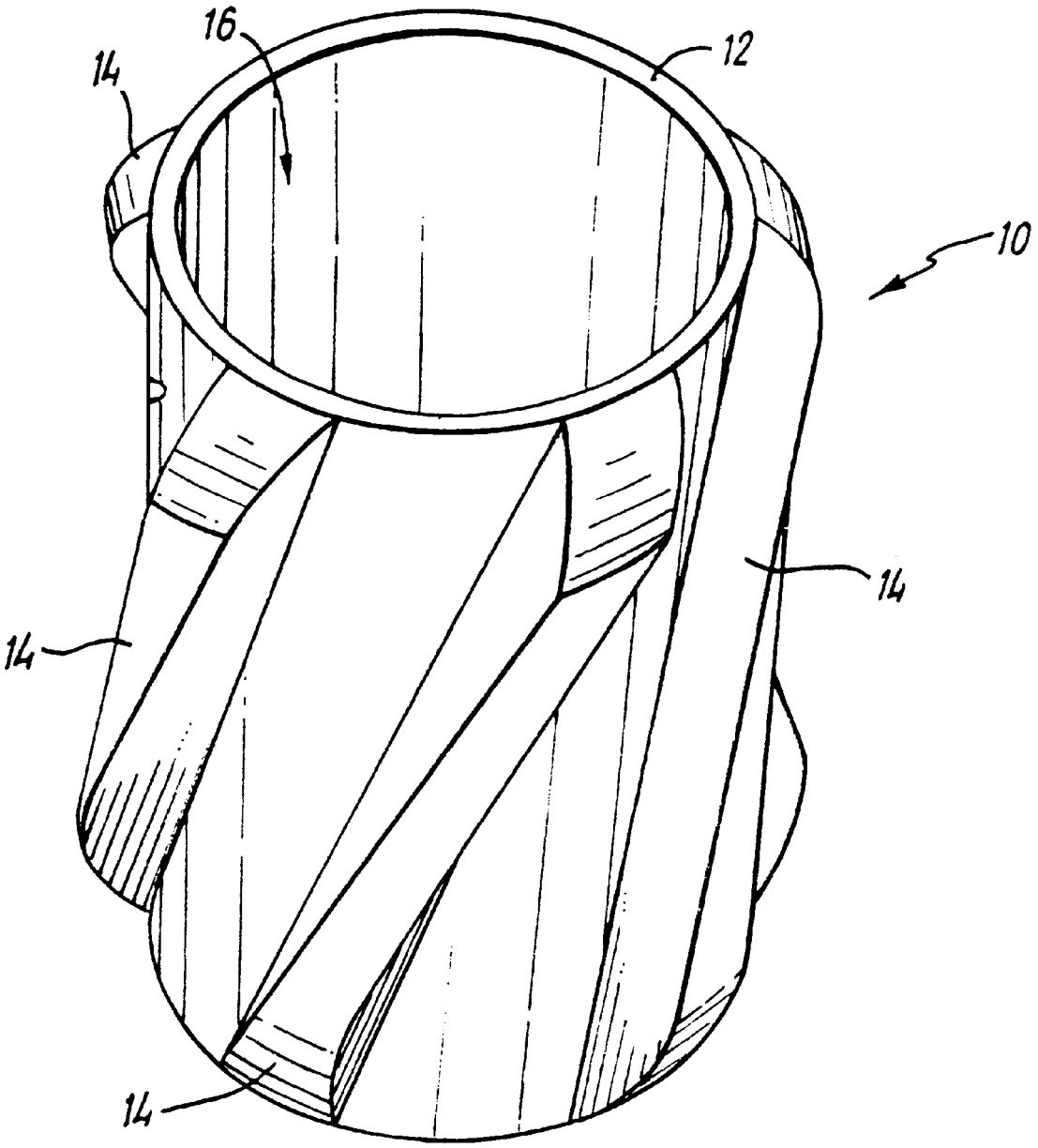
FIG. 1 is a perspective view from above and to one side of a first embodiment of casing centraliser in accordance with the first aspect of the present invention.
Figure 2:
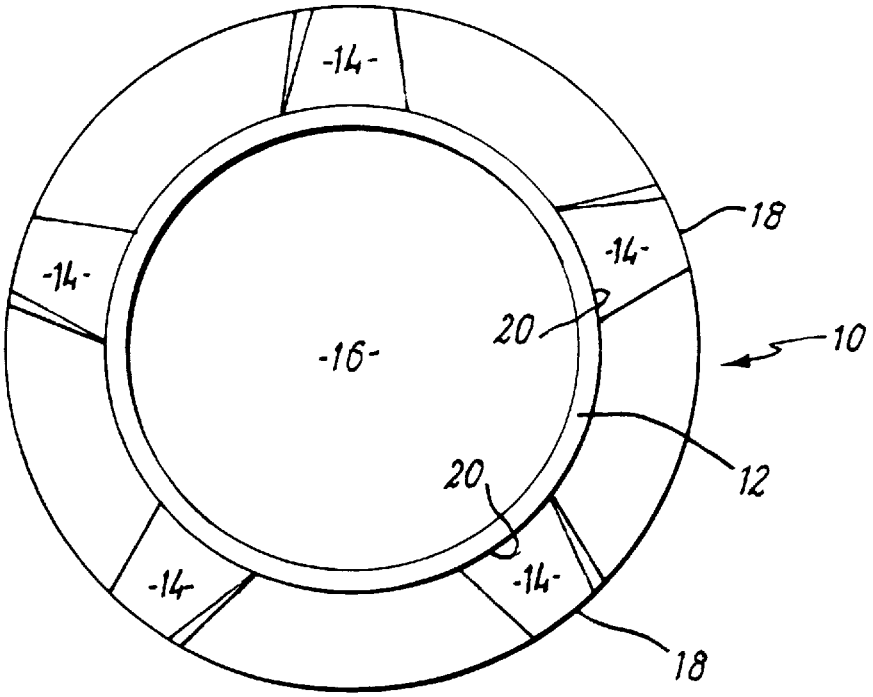
FIG. 2 is a plan view from above of the first embodiment.
Figure 3:
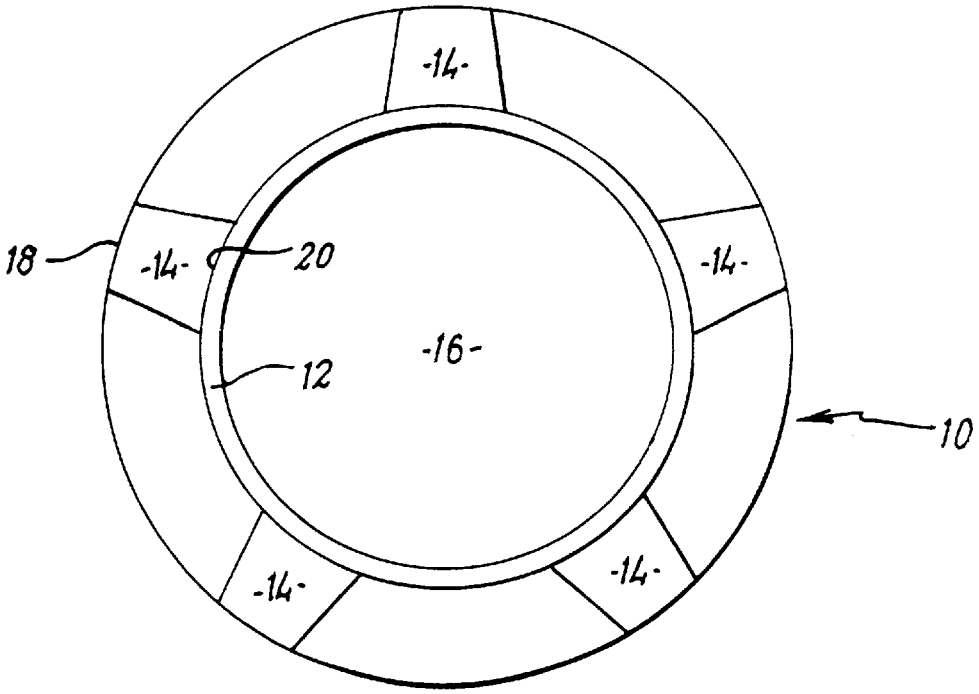
FIG. 3 is an underneath view of the first embodiment.

Referring first to FIGS. 1–3, a casing centraliser 10 in accordance with the present invention is a unitary annulus comprising a generally cylindrical body 12, and an array of five equiangularly-spaced blades 14 integrally formed with the body 12. A cylindrical bore 16 extends longitudinally and coaxially through the body 12, the bore 16 having a substantially uniform diameter dimensioned to be a clearance fit around the well bore casing (not shown in FIGS. 1–8).

Each of the blades 14 (see also FIGS. 4&5) not only extends between longitudinally opposite ends of the body 12, but also extends circumferentially part-way around the periphery of the centraliser 10. The skewing of the blade 14 ensures that their respective radially outer edges 18 collectively provide a circumferentially substantially uniform well bore-contacting surface for the centraliser 10, as most particularly shown in FIGS. 2 and 3.

Each of the blades 14 has a respective radially inner root 20 integral with the body 12. In each of the blades 14, the root 20 has a greater circumferential width than the outer edge 18, ie the cross-section of each blade 14 tapers towards the well bore-contacting periphery of the centraliser 10. The individual and collective shapes of the blades 14, and of the longitudinal fluid flow passages defined between adjacent pairs of the blades 14, gives the contraliser 10 improved flow characteristics and minimises the build-up of trapped solids during use of the centraliser 10.

Longitudinally opposite ends of the blades 14, and of the body 12, are chamfered to assist in movement of the centraliser 10 up/down a well bore.

Figure 4:
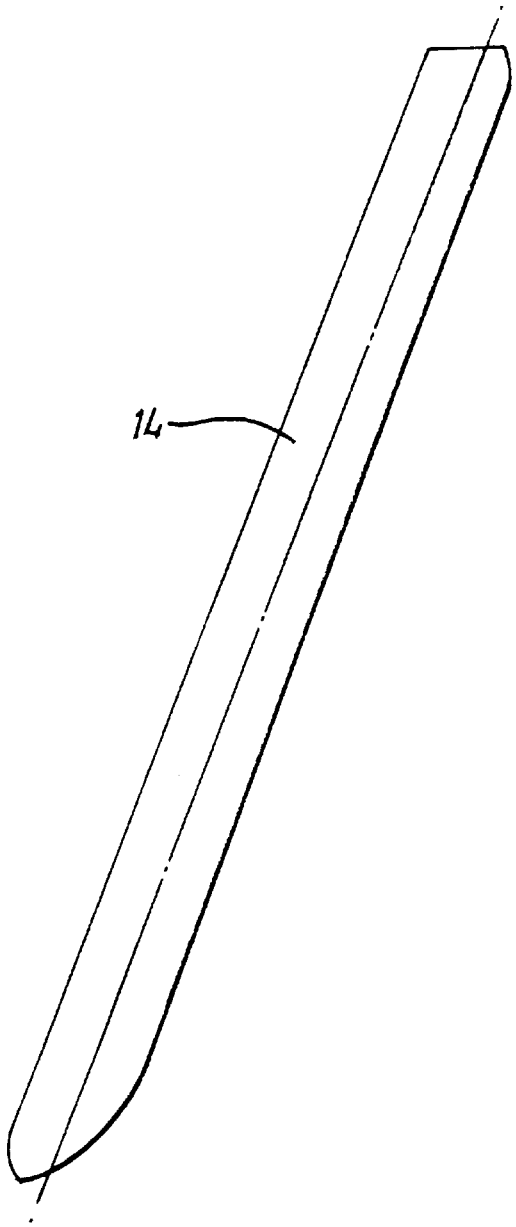
FIGS. 4 and 5 are respectively radial (plan) and circumferential (side) views of a blade forming part of the first embodiment.
Figure 5:
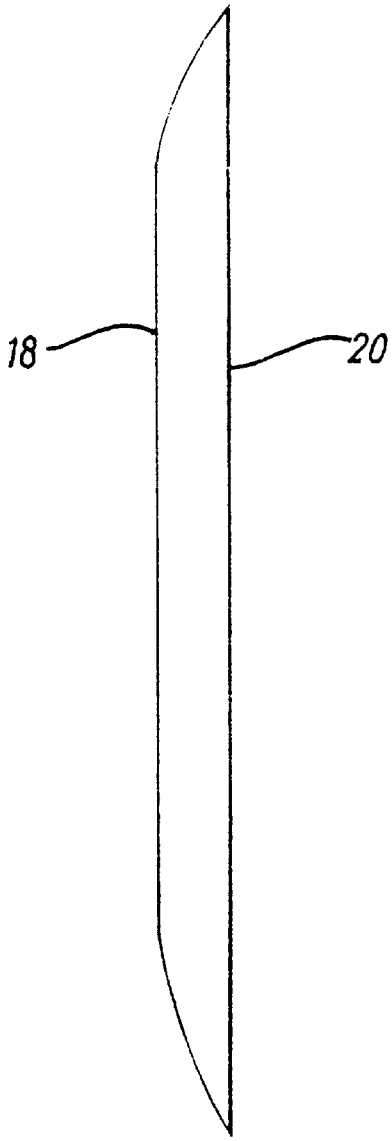

Although the blades 14 are shown separately from the body 12 in FIGS. 4 and 5 (and while the blades 4 could be separately formed and subsequently attached to the body 12 by any suitable means) it is preferred that the entire centraliser 10 be fabricated as a one-piece articles, preferably by being precision cast in a suitable metal or alloy.

A preferred material for forming the centraliser 10 is a zinc alloy, most preferably one of the "ZA" range of zinc alloys supplied by the Brock Alloys Company of the United Kingdom. Use of a zinc alloy in general, and of one of the "ZA" alloys in particular gives a number of advantages; the zinc alloy is non-sparking (ie sparks are not generated if the centraliser 10 collides with steel), the zinc alloy provides superior bearing properties, exceptional resistance to wear and abrasion, excellent strength and hardness, and the zinc component of the alloy offers cathodic protection to the casing around which the centraliser 10 is located.

Figure 6:
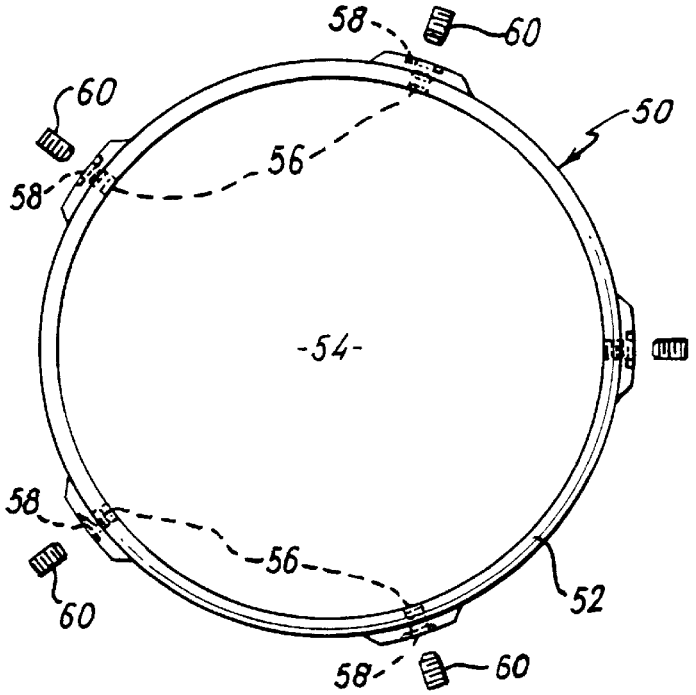
FIGS. 6, 7 and 8 are respectively plan, perspective and side views of a casing stop collar in accordance with the second aspect of the present invention and suitable for use in conjunction with the first aspect of the present invention.
Figure 7:
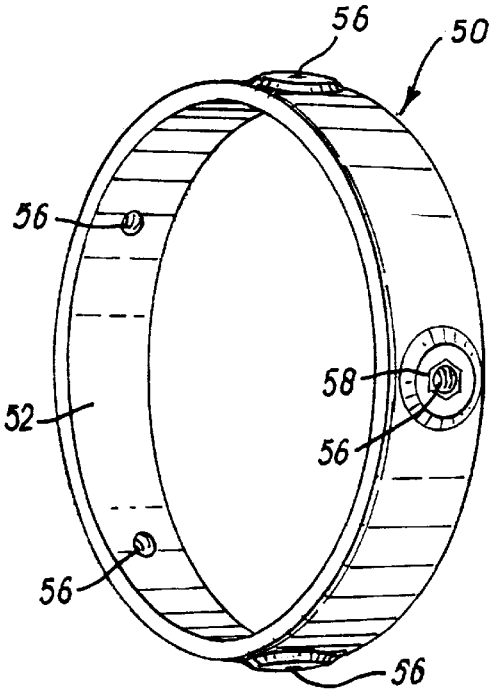
Figure 8:
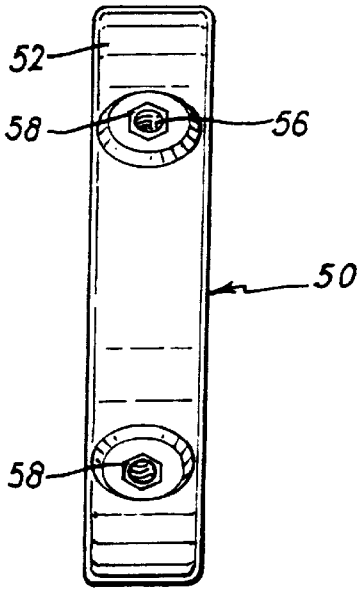

Since the bore 16 is a clearance fit around the casing and since the bore 16 lacks any means of tightly gripping a normally dimensioned casing, the centralizer 10 can not only rotate freely around the casing but also move freely along the casing (unless and until the centraliser collides with an obstruction, for example a protruding casing joint). Thus to provide longitudinal restraint for the centraliser 10 to retain the centraliser substantially at its preferred location along the casing but without impairing the relative rotatability of centraliser and casing, use is made of a stop collar 50 as illustrated in FIGS. 6, 7 and 8 to which reference will now be made.

The stop collar 50 comprises an undivided ring 52 having a bore 54 about equal in diameter to the bore 16 in order to fit alongside the centraliser 10 on the same casing. The ring 52 is radially penetrated by five internally threaded holes 56. The ring 52 is cast of the same zinc alloy as the centraliser 10, and five thread inserts 58 are either cast into the ring 52 to form the threaded holes 56, or subsequently screwed into or pressed into a previously cast ring.

In use of the stop collar 50, the ring 52 is fitted around the casing in correct relationship to the intended location of a centraliser. A grub screw 60 is then screwed down each of the threaded holes 56 to tighten against the underlying casing (not shown in FIGS. 6–8) so as to lock the collar 50 onto the casing.

The locked-on collar 50 then provides an abutment which stops longitudinal movement of the centraliser in one direction while not inhibiting free relative rotation of the centraliser and the casing. While a single stop collar would normally be located under a centraliser on vertical or near-vertical casing to prevent unrestricted dropping of the centralizer down the casing, circumstances may dictate that a stop collar be located above a centraliser, or that a respective stop collar be used at each end of a centraliser.

Figure 9:
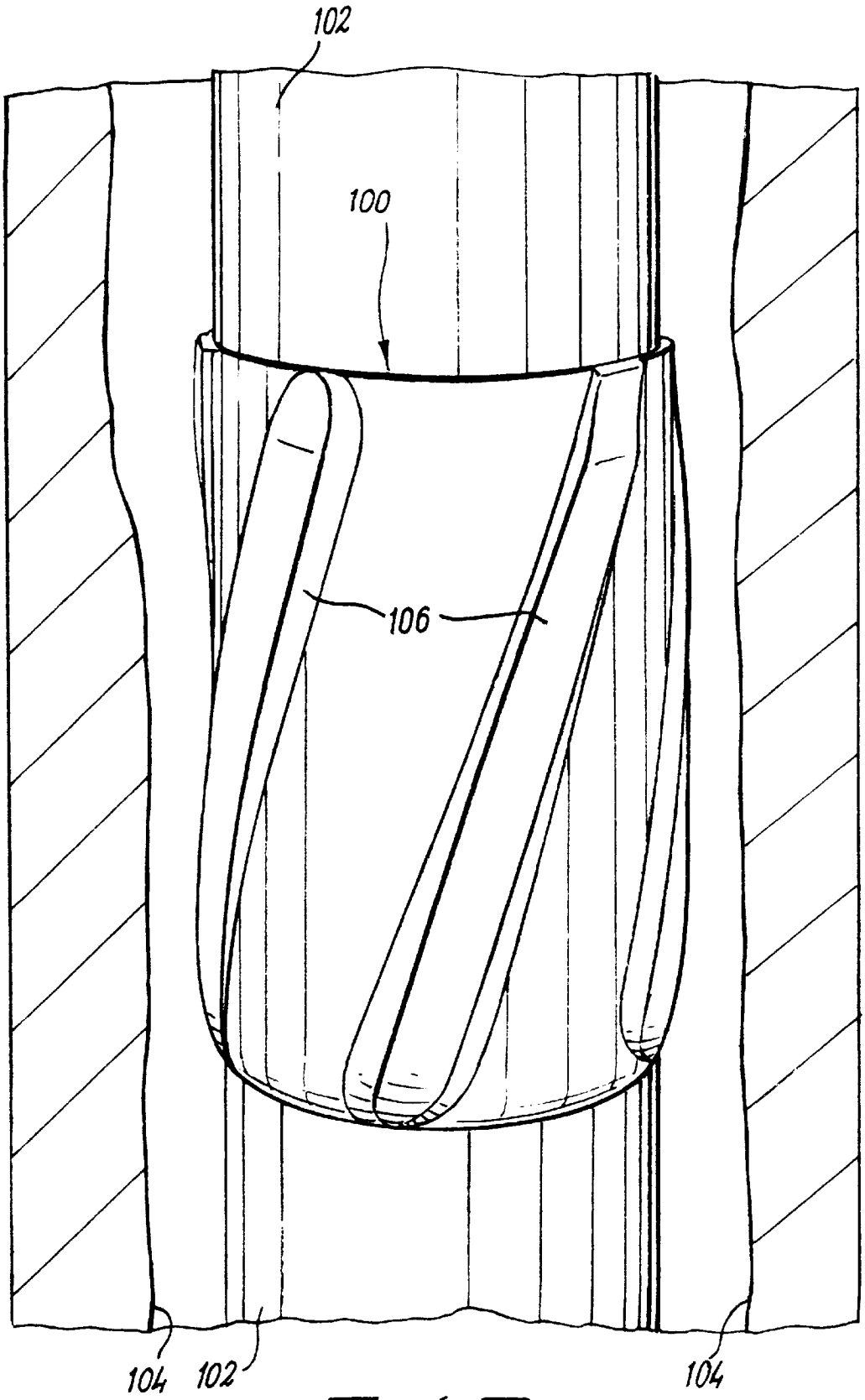
FIG. 9 is a perspective view of a combination in accordance with the third aspect of the present invention.

FIG. 9 shows a modified form of casing centraliser 100, fitted around hollow tubular casing 102 which is located within a well bore 104. The modified centraliser 100 is essentially the same as the centraliser 10 described above, and differs principally in the dimensions and proportions of its blades 106. In particular, the blades 106 are circumferentially wider at the lower end of the centraliser 100 than they are at the upper end. FIG. 9 also illustrates the manner in which the centralizer will hold casing out of direct contact with the wall bore and centrally within the well bore, in preparation for subsequent cementing.

In the case of casing located within larger diameter casing, centralisers can be employed on the inner casing to hold it out of direct contact with the outer casing.

Centralisers in accordance with the invention can also be employed on drillstrings as rotary stabilisers.

While certain preferred embodiments of the invention have been described above, the invention is not restricted thereto, and modifications and variations thereof can be adopted without departing from the scope of the invention.

We claim:

1. A casing centraliser comprising an annular body, a substantially cylindrical bore extending longitudinally through said body, and a peripheral array of a plurality of longitudinally extending blades circumferentially distributed around said body to define a flow path between each circumferentially adjacent pair of said blades, each said flow path providing a fluid flow path between longitudinally opposite ends of said centraliser, each said blade having a radially outer edge providing a well bore-contacting surface, and said cylindrical bore through said body being a clearance fit around tubular casing intended to be centralised by said casing centraliser, wherein the annular body has an upper and a lower end, the fluid flow path extending between said upper and lower end, and wherein each blade is circumferentially wider at said lower end than at said upper end.

2. Apparatus according to claim 1, wherein the centraliser is manufactured from a material which comprises zinc.

3. A centraliser according to claim 2, wherein the material is a zinc alloy.

4. A casing centraliser according to claim 1, wherein the blades are substantially equidistantly distributed around the body.

5. A casing centraliser according to claim 1, wherein the blades circumferentially extend at least part way around the body between longitudinally opposite ends of the blades.

6. A casing centraliser according to claim 1, wherein each blade includes a radially inner route integral with the body, each radially inner route being circumferentially wider than the respective radial outer edge of the blade.

7. A casing centraliser according to claim 1, wherein each of the blades are circumferentially wider at one end of the centraliser than at the other end.

8. A casing centraliser according to claim 1, wherein five blades are provided on the body.

9. A method of centralising a casing tubular in an oil or gas well bore, the method comprising:

(i) providing a casing centraliser comprising an annular body, a substantially cylindrical bore extending longitudinaly through said body, and a peripheral array of a plurality of longitudinally extending blades circumferentially distributed around said body to define a flow path between each circumferentially adjacent pair of said blades, each said flow path providing a fluid flow path between longitudinally opposite ends of said centraliser, each said blade having a radially outer edge providing a well bore-contacting surface, and said cylindrical bore through said body being a clearance fit around tubular casing intended to be centralised by said casing centraliser; and (ii) installing the centraliser on the casing tubular so that the upper end of the annular body of the centraliser is uppermost, and the lower end of the annular body of the centraliser is lowermost; whereby the fluid flow path between the blades of the centraliser installed on the casing tubular is wider at its upper end than at its lower end.

* * * * *